US006830598B1

(12) United States Patent
Sung

(10) Patent No.: US 6,830,598 B1
(45) Date of Patent: Dec. 14, 2004

(54) MOLTEN BRAZE COATED SUPERABRASIVE PARTICLES AND ASSOCIATED METHODS

(75) Inventor: Chien-Min Sung, No. 4, Lane 32, Chung-Cheng Road, Tansui, Taipei County (TW), 23911

(73) Assignee: Chien-Min Sung (TW)

( * ) Notice: Subject to any disclaimer, the term of this patent is extended or adjusted under 35 U.S.C. 154(b) by 33 days.

(21) Appl. No.: 10/254,057

(22) Filed: Sep. 24, 2002

(51) Int. Cl.[7] ..... B24D 3/00; B24D 17/00; B24D 18/00

(52) U.S. Cl. ..... 51/307; 51/308; 51/309; 51/295; 51/298

(58) Field of Search ..... 51/307, 308, 309, 51/298, 295; 427/214, 217, 431, 443.2

(56) References Cited

U.S. PATENT DOCUMENTS 4,239,502 A * 12/1980 Slack et al. ..... 51/295
5,024,680 A 6/1991 Chen et al.
5,096,465 A 3/1992 Chen et al.
5,116,568 A 5/1992 Sung et al.
5,230,718 A * 7/1993 Oki et al. ..... 51/295
5,755,298 A 5/1998 Langford, Jr. et al.
5,755,299 A 5/1998 Langford, Jr. et al.
6,039,641 A 3/2000 Sung
6,102,140 A 8/2000 Boyce et al.
6,238,280 B1 5/2001 Ritt et al.

* cited by examiner

*Primary Examiner*—Michael Marcheschi
(74) *Attorney, Agent, or Firm*—Thorpe North & Western, LLP

(57) ABSTRACT

A superabrasive particle coated with a solidified coating of a molten braze alloy that is chemically bonded to the superabrasive particle is disclosed and described. In one aspect, the reactive metal alloy may be chemically bonded to at least about 80% of an outer surface of the superabrasive particle. Various methods for making and using such a coated superabrasive particle are additionally disclosed and described.

43 Claims, No Drawings

MOLTEN BRAZE COATED SUPERABRASIVE PARTICLES AND ASSOCIATED METHODS

FIELD OF THE INVENTION

The present invention relates to devices that incorporate superabrasive materials, and methods for the production and use thereof. Accordingly, the present invention involves the fields of chemistry, physics, and materials science.

BACKGROUND OF THE INVENTION

A variety of abrasive and superabrasive tools have been developed over the past century for performing the general function of removing material from a workpiece. Actions such as sawing, drilling, polishing, cleaning, carving, and grinding, are all examples of material removal processes that have become fundamental to a variety of industries.

A number of specific material removal applications require the use of superabrasive tools. In these cases, the use of conventional abrasive tools may be infeasible due to the nature of the workpiece, or the surrounding circumstances of the process. For example, activities such as cutting stone, tile, cement, etc. are often cost prohibitive, if not impossible to accomplish, when attempted using a conventional saw blade. Additionally, the economy and performance of other material removal activities may be increased when using superabrasive tools, due to their greater durability.

One common way in which superabrasive materials have been incorporated into a tool is as superabrasive particles. In this case, the superabrasive particles are most often embedded in a matrix, such as a metal matrix, and held in place by the mechanical forces created by the portion of the matrix directly surrounding the particles. A variety of consolidation techniques, such as electroplating, sintering, or hot pressing, a matrix around superabrasive particles are known. However, because the matrix surrounding the superabrasive particles is softer than the superabrasive particles, it wears away more quickly, during use, and leaves the diamond particles overexposed, and unsupported. As a result, the diamond particles become prematurely dislodged and shorten the service life of the tool.

A number of attempts have been made to overcome the above-recited shortcoming. Most notably, several techniques that attempt to chemically bond the superabrasive particles to the matrix, or other substrate material, have been employed. The main focus of such techniques is to coat or otherwise contact the superabrasive particle with a reactive element that is capable of forming a carbide bond between the superabrasive particle and the metal matrix, such as titanium, chromium, tungsten, etc. Examples of specific processes include those disclosed in U.S. Pat. Nos. 3,650,714, 4,943,488, 5,024,680, and 5,030,276, each of which are incorporated herein by reference. However, such processes are difficult and costly for a variety of reasons, including the highly inert nature of most superabrasive particles, and the high melting point of most reactive materials.

Further, the melting point of most reactive metal materials is well above the stability threshold temperature of most superabrasives. To this end, the method by which the reactive material may be applied to the superabrasives is generally limited to either solid-state reactions or gas reactions that are carried out at a temperature that is sufficiently low so that damage to the diamond does not occur. Such processes are only capable of achieving a monolithic coating, and cannot produce an alloy coating. While the strength of the carbide bonds yielded using these techniques generally improves particle retention over mere mechanical bonds, they still allow superabrasive particles to become dislodged prematurely.

Another method of forming carbide bonds is by using a braze alloy that contains a reactive element. The braze alloy is consolidated around the superabrasive particles by sintering. One example of a specific process of this type is found in U.S. Pat. No. 6,238,280, which is incorporated herein by reference. While such processes may yield a tool that has greater grit retention than tools having no chemical bonding of the superabrasive particles, as a general matter, solid-state sintering of the braze alloy only consolidates the matrix material, and does not attain as much chemical bonding as the solid and gas state deposition techniques.

Additionally, the use of conventional braze may be limited, as it generally also serves as the matrix material for the body of the tool. Most braze alloys are ill equipped to act as a bonding medium and simultaneously act as the matrix material, due to the specific characteristics required by each of these elements during use. For example, in order to achieve greater carbide bonding, some superabrasive particles may require alloys that are too soft for the intended tool application. A matrix that is made of a material that is too soft may wear away too quickly and allow the superabrasive particles to dislodge prematurely.

As such, superabrasive tools that display improved superabrasive particle retention and wear characteristics, including methods for the production thereof, continue to be sought through ongoing research and development efforts.

SUMMARY OF THE INVENTION

Accordingly, the present invention provides superabrasive tools having improved superabrasive particle retention, and methods for the making thereof As a basic component of such tools, the present invention additionally provides a coated superabrasive particle having improved retention properties when incorporated into a tool. In one aspect, the coated superabrasive particle may include a superabrasive particle, and a solidified coating of a molten braze alloy that is chemically bonded to the superabrasive particle.

In one aspect of the invention, a coated superabrasive particle may be made by the basic steps of: covering the superabrasive particle with the braze alloy in a molten liquid state, and solidifying the liquid braze alloy around the superabrasive particle. Due to the liquid state of the alloy, it is able to wet the superabrasive particle and spread over the surface thereof. As a result, chemical bonds are formed at the interface of the metal and the superabrasive particle, which provide a bonding strength of about 5 to 10 times greater than that achieved with either electroplating or sintering. Hence, when used in a superabrasive tool, the superabrasive grit can protrude further out of the support material and achieve a higher rate of material removal. Furthermore, tool life is lengthened because the rate at which superabrasive grits are pulled out of or dislodged from the support material is significantly slowed.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an" and, "the" include plural referents unless the context clearly dictates otherwise. Thus, for example, reference to "a diamond particle" includes one or more of such particles, reference to "a carbon source" includes reference to one or more of such carbon sources, and reference to "a reactive material" includes reference to one or more of such materials.

Definitions

In describing and claiming the present invention, the following terminology will be used in accordance with the definitions set forth below.

As used herein, "super hard" arid "superabrasive" may be used interchangeably, and refer to a crystalline, or polycrystalline material, or mixture of such materials having a Vicker's hardness of about 4000 $Kg/mm^2$ or greater. Such materials may include without limitation, diamond, and cubic boron nitride (cBN), as well as other materials known to those skilled in the art. While superabrasive materials are very inert and thus difficult to form chemical bonds with, it is known that certain reactive elements, such as chromium and titanium are capable of chemically reacting with superabrasive materials at certain temperatures.

As used herein, "metallic" refers to a metal, or an alloy of two or more metals. A wide variety of metallic materials are known to those skilled in the art, such as aluminum, copper, chromium, iron, steel, stainless steel, titanium, tungsten, zinc, zirconium, molybdenum, etc., including alloys and compounds thereof.

As used herein, "particle" and "grit" may be used interchangeably, and when used in connection with a superabrasive material, refer to a particulate form of such material. Such particles or grits may take a variety of shapes, including round, oblong, square, euhedral, etc., as well as a number of specific mesh sizes. As is known in the art, "mesh" refers to the number of holes per unit area as in the case of U.S. meshes.

As used herein, "reactive element" and "reactive metal" may be used interchangeably, and refer to a metal element that can chemically react with and chemically bond to a superabrasive particle. Examples of reactive elements may include without limitation, transition metals such as titanium (Ti) and chromium (Cr), including refractory elements, such as zirconium (Zr) and tungsten (W), as well as non-transition metals and other materials, such as aluminum (Al). Further, certain elements such as silicon (Si) which are technically non-metals may be included as an reactive element in a brazing alloy.

As used herein "wetting" refers to the process of flowing a molten metal across at least a portion of the surface of a superabrasive particle. Wetting is often due, at least in part to the surface tension of the molten metal, and leads to the forming chemical bonds between the superabrasive particle and the molten metal at the interface thereof. Accordingly, a tool having superabrasive particles that are "wet" by a metal indicates the existence of chemical bonds between the superabrasive particles and the metal at the interface thereof.

As used herein, "chemical bond" and "chemical bonding" may be used interchangeably, and refer to a molecular bond that exert an attractive force between atoms that is sufficiently strong to create a binary solid compound at an interface between the atoms. Chemical bonds involved in the present invention are typically carbides in the case of diamond superabrasive particles, or nitrides or borides in the case of cubic boron nitride.

As used herein, "braze alloy" and "brazing alloy" may be used interchangeably, and refer to an alloy containing a sufficient amount of a reactive element to allow the formation of chemical bonds between the alloy and a superabrasive particle. The alloy may be either a solid or liquid solution of a metal carrier solvent have a reactive element solute therein. Moreover, the "brazed" may be used to refer to the formation of chemical bonds between a superabrasive particle and a braze alloy.

As used herein, "coat," "coating," and "coated," with respect to a reactive metal alloy, or a braze alloy, refers to a layer of such an alloy that is chemically bonded to a superabrasive particle along at least a portion of an outer surface of the superabrasive particle. In some aspects, the layer may substantially encase or enclose the entire superabrasive particle, while being chemically bonded thereto. It is to be understood that such layers are limited in some instances to a certain thickness. Further, it is to be understood that a "coating" is distinct from a metallic matrix or mass into which a coated particle is incorporated, even though the material of a coating may be similar to, or the same as, such a metallic matrix or mass. Moreover, it is not possible, that such a matrix or mass of a tool body serve as the coating of a particle as used herein. However, it is possible that a number of coated particles be consolidated together and a support matrix for the diamond particles formed from the coating of the particles.

As used herein, "separator" refers to any form of a material that is capable of separating superabrasive particles during the process of coating such superabrasive particles with a molten braze alloy. In one aspect, the separator may be thermally resistant powder that has no affinity to chemically react with the molten braze alloy. In another aspect, the separator may be a sheet, tray, or other forms with a plurality of apertures for separating the particles.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 micrometer to about 5 micrometers" should be interpreted to include not only the explicitly recited values of about 1 micrometer to about 5 micrometers, but also include individual values and sub-ranges within the indicated range. Thus, included in this numerical range are individual values such as 2, 3, and 4 and sub-ranges such as from 1–3, from 2–4, and from 3–5, etc.

This same principle applies to ranges reciting only one numerical value. Furthermore, such an interpretation should apply regardless of the breadth of the range or the characteristics being described.

Invention

The present invention encompasses superabrasive tools having improved superabrasive particle retention, as well as various components thereof, such as a coated superabrasive grit. Additionally, the present invention encompasses various methods for the fabrication of such tools and components. In one aspect, the present invention provides a coated superabrasive particle that includes a superabrasive particle, and a solidified coating of a molten braze alloy which is chemically bonded to the superabrasive particle.

The superabrasive particles used may be selected from a variety of specific types of diamond (e.g. polycrystalline diamond) and cubic boron nitride (e.g. polycrystalline cBN), and are capable of chemically bonding with a reactive material. Further, such particles may take a number of different shapes as required to accommodate a specific purpose for the tool into which it is anticipated that they will be incorporated. However, in one aspect, the superabrasive particle may be diamond, including natural diamond, synthetic diamond, and polycrystalline diamond (PCD). In yet another aspect, the superabrasive particle may be cubic boron nitride (cBN), either single crystals or polycrystalline.

Additionally, a number of reactive elements may be used in the metal alloy in order to achieve the desired chemical bonding with the superabrasive. A wide variety of reactive elements that can be alloyed with a metallic carrier are known to those skilled in the art, and the selection of a particular reactive element may depend on various factors. Examples of suitable reactive elements for inclusion in the braze alloy used in the present invention include without limitation, members selected from the group consisting of: aluminum (Al), boron (B), chromium (Cr), lithium (Li), magnesium (Mg), molybdenum (Mo), manganese (Mn), nirobium (Nb), silicon (Si), tantalum (Ta), titanium (Ti), vanadium (V), tungsten (W), zirconium (Zr), and mixtures thereof. In addition to the reactive element or elements, the braze alloy used to form the coating in accordance with the present invention includes at least one other metal as a carrier or solvent. Any metal recognized by one of ordinary skill in the art may be used as such a carrier or solvent, especially those known for use in making superabrasive tools. However, by way of example, without limitation, in one aspect of the present invention, such metals may include, Co, Cu, Fe, Ni, and alloys thereof.

As alluded to above, one goal of alloying a reactive element with another metal is to reduce the effective melting point of the reactive element, while maintaining its ability to chemically bond with a superabrasive particle. As is known in the art, the thermal stability limit of many superabrasive materials, such as diamond, ranges from about 900° C. to about 1200° C. As such, in one aspect of the invention, the components and exact ratios of the reactive metal alloy may be selected to provide an alloy that has a melting point within or below the thermal stability limit of the particular superabrasive material being used. In practice, a solvent metal may be selected and combined with an reactive element in proper amounts to reduce the melting temperature of both elements and yield a braze alloy having a melting temperature of less than about 1200° C. In yet another aspect, the melting temperature may be below about 900° C.

As will be recognized by those of ordinary skill in the art, numerous combinations of specific reactive metals and other specific carrier metals may be alloyed in different ratios or amounts to achieve an alloy that chemically bonds to the superabrasive particle, and has a suitable melting point. However, in one aspect, the content of the reactive element may be at least about 1% of the alloy. In another aspect, the amount of element may be at least about 5% of the alloy.

Notably, the improved retention aspects of the coated abrasive particles of the present invention are due in large measure to the amount of chemical bonding that is achieved between the coating and the superabrasive particle. The absence or nominal presence of such chemical bonding is a primary cause of premature grit pullout in tools employing known methods, such as electroplating and sintering.

One advantage presented by the method of the present invention is the ability to vary or control the thickness of the reactive metal alloy coating around the superabrasive particle. Such an ability is enabled by the molten liquid state in which the alloy is applied, as will be discussed in further detail below. Specific thicknesses may be selected by one of ordinary skill in the art, as required to accomplish a particular purpose. However, in one aspect of the invention, the coating may have a thickness of at least about 1 micrometer. In another aspect, the coating may have a thickness of at least about 50 micrometers.

The particle coating may be accomplished in a single layer, or by the production of multiple layers. In one aspect of the invention, the coating may further include at least one metallic overcoat layer that is bonded to an outside portion of the solidified braze alloy coating. A number of materials may be used for such a metallic overcoat, as will be recognized by those of ordinary skill in the art, and specific selection may be based on a number of factors, including the main matrix material and design of the tool into which the coated particle is to be incorporated. However, in one aspect, the metallic overcoat may include at least one metal selected from the group consisting of Co, Cu, Fe, Ni, and mixtures thereof. As will be recognized, one or more overcoats may be utilized to achieve a desired total coating thickness for the coated particle. In one aspect, the total coating thickness achieved around the superabrasive particle may be greater than the diameter of the superabrasive particle.

In addition to the metallic overcoat, a number of various other materials may be applied as an overcoat on the solidified braze alloy coating. In some aspects, such materials may be particulate materials of various constitution, with the proviso that such particulates each have a size that is smaller than the coated superabrasive particle. Examples of specific types include without limitation, metallic particulates, metallic alloy particulates, such as carbides, or superabrasive particulates. Examples of specific carbide particulates include without limitation, SiC, WC, and Ti coated cBN. Such coatings have been found to further increase the retention strength of the superabrasive particle. Specifically, coatings of these type effect a gradual or "gradient" transition between the outside of the reactive metal alloy coating, and the matrix material of the tool into which the coated superabrasive particle is incorporated. Thus, the weak interface created by a sharper transition between two materials is eliminated.

In one aspect of the present invention, the molten braze alloy may wet at least about 40% of the surface of the superabrasive particle. In another aspect, the alloy may wet at least about 50% of the surface of the superabrasive particle. In yet another aspect, the alloy may wet at least about 60% of the surface of the superabrasive particle. In some aspects, at least about 80% or greater of the surface of the superabrasive particle may be wetted by the braze alloy.

Once the coated superabrasive particle is complete, it may be incorporated into a tool. A number of tools may find use for such coated superabrasive particles, including without limitation, saw blades, drill bits, grinding wheels, and chemical mechanical polishing pad dressers, among others. A number of ways of incorporating the coated particle into such tools will be recognized by one of ordinary skill in the art, and the specific method of integration may be determined by a number of factors, such as the other materials in the tool, tool configuration, tool purpose, etc.

The present invention additionally encompasses various methods of making and using superabrasive tools, including various components thereof as described herein. Such methods may employ the materials, structures, dimensions, and other parameters disclosed for the device above, as well as equivalents thereof as recognized by one of ordinary skill in the art. In one aspect, the present invention includes a method of chemically bonding a superabrasive particle to a reactive metal alloy coating. Such a method may include the steps of: covering the superabrasive particle with the braze alloy in a molten liquid state, and solidifying the liquid braze alloy around the superabrasive particle, such that the reactive metal alloy becomes chemically bonded with the superabrasive particle.

Those of ordinary skill in the art will recognize a number of ways to cover the superabrasive particle with the molten braze alloy, such as by dipping the particles in the alloy, and dripping the alloy onto the particles, among other application techniques. However, in one aspect of the invention, the step of covering may further include the steps of: coating the superabrasive particle with an organic binder material, adhering a powdered form of braze alloy to the superabrasive particle with the organic binder material, and heating the reactive metal alloy to a temperature sufficient to cause the alloy to melt and coat and chemically bond to the superabrasive particle.

A variety of organic binders will be recognized as suitable for use in this context by those of ordinary skill in the art. However, in one aspect, the binder material may be a member selected from the group consisting of: polyvinyl alcohol (PVA), polyvinyl butyral (PVB), polyethylene glycol (PEG), pariffin, phenolic resin, wax emulsions, and acrylic resins. In another aspect, the binder may be PEG. Further, the applying the powdered form of the reactive metal alloy to the binder coated particle for the purposes of adhering the alloy thereto may be accomplished by various methods, such as rolling; dipping, or tumbling the binder coated particles with the powder. Further, such application may be accomplished by various methods of spraying, showering, projecting, or otherwise directing the powder onto the superabrasive particles to form the desired coating. One example of such a method is by the use of a fluidized bed stream. Other methods of adhering the powder to the binder coated particles will be recognized by those of ordinary skill in the art.

A variety of ways for heating the powder coated superabrasive particles may be employed as recognized by those of ordinary skill in the art. No particular limitation is placed on the specific heating mechanism employed, other than the ability to reach a temperature sufficient to melt the powdered braze alloy into a molten liquid state. Once melted, the liquid alloy will wet the superabrasive particles and form the desired chemical bonds at the interface thereof. Further, other mechanisms in addition to heat may be used to facilitate the melting and liquefaction of the alloy, such as by adding a flux, or other methods as will be recognized by those of ordinary skill in the art, so long as such methods do not hinder or prevent the wetting of the superabrasive particles and the formation of the desired chemical bonds.

Under some circumstances, it may be desirable to first coat or "pre-treat" the superabrasive particle with certain materials, prior to covering it with the molten braze alloy. For example, when the superabrasive particle being used is cBN, or an other superabrasive material that is extremely inert. The high inertness of such materials may make it quite difficult to create chemical bonds with the molten braze alloy. Therefore, in one aspect of the present invention, the superabrasive particle may be conditioned by forming a pre-treatment layer of a reactive material on the superabrasive particle. Such layers may typically be formed by conventional methods, such as the solid state and vapor deposition techniques discussed above. In one aspect, the pre-treatment layer may be a reactive material selected from the group consisting of: Cr, Si, Ti, and W. In another aspect, the pre-treatment material may be Ti. Those of ordinary skill in the art will recognize other suitable materials that may be first deposited on the superabrasive particle, including materials formed in multiple layers, in order to facilitate or enhance the formation of chemical bonding with the molten braze alloy.

As a practical matter, it may often be the case that a plurality of superabrasive particles are simultaneously coated with the molten braze alloy in a single processing event. In such instances, according to certain aspects of the present invention, it may be desirable to prevent coated particles from fusing or joining together. As such, in one aspect, the heating step of the present method may include the steps of: distributing the superabrasive particles in a separator that allows separation of the particles during heating, heating the reactive metal alloy to a temperature sufficient to cause the alloy to melt and wet and chemically bond to the superabrasive particle, and removing the superabrasive particles from the separator. A variety of separating methods and devices may be employed. The specific selection of a particular separator may be dictated by factors such as speed, economy, and quality of result achieved. However, in one aspect, the separator may be a powder which does not react with the braze alloy, and which can tolerate high temperatures. Examples of such materials include without limitation, oxide powders, such as $Al_2O_3$, $SiO_2$, or $ZrO_2$, and nitride powders, such as BN, AIN. Other non-reactive powdered materials will be recognized by those of ordinary skill in the art.

In another aspect, the separator may be a plate with a plurality of apertures therein. The specific size and placement of the apertures may be determined in part by the size and shape of the superabrasive grit being coated. However, as a general procedure, a single superabrasive grit may be placed in each aperture of the plate, in either a coated, or uncoated state. Excess grits are swept off the plate, and the apertures are then filled with braze powder. The plate containing the grits and braze alloy is then subjected to a sufficient amount of heat to melt the braze alloy and cause the wetting of the grits and the formation of chemical bonds. In the case where grits have not been pre-coated prior to deposition in the apertures, powdered coating may then be placed in, or over, the aperture, and will cover and attach to the superabrasive particle when melted by a sufficient amount of heat.

After the melted braze alloy has bonded to the superabrasive particles, the particles are allowed to cool, and the braze alloy solidifies. Once the alloy has solidified, the coated superabrasive particles are removed from the separator and may be either subjected to additional processing steps as alluded to above, such as by applying one or more overcoats, or by bonding additional smaller particles thereto. Alternatively, the coated superabrasive particles may be directly incorporated into a tool by coupling the particles to a tool body, for example, by impregnating the coated grits into a matrix, or in some aspects, by simply coupling a plurality of particles together.

A variety of superabrasive tools may be made using the coated superabrasive particles of the present invention. For example, coated particles may be incorporated into a tool by bonding the particles to a matrix support material or substrate. Moreover, the arrangement of such particles may be in accordance with a predetermined pattern or specific configuration. Examples of specific methods of effecting such patterns or configurations of superabrasive particles may be found in U.S. Pat. Nos. 4,925,457, 5,380,390, 6,039,641, and 6,286,498, each of which is incorporated herein by reference. Additionally, a variety of tools may be made by simply bonding a plurality of coated superabrasive particles together. For example, numerous one dimensional configurations, such as a needle (i.e. single file line of coated particles bonded together), may be made. Two dimensional configurations, such as a plate, (i.e. a number of single file lines of particles laterally bonded together), can also be constructed, as well as three dimensional configurations, (i.e. a plurality of plates stacked or layered and bonded together. Moreover, a number of uses for individually coated particles not incorporated into a tool will be recognized by those of ordinary skill in the art as loose abrasives.

Those of ordinary skill in the art will readily recognize a number of ways of creating specifically desired configurations, such as by using a mold, etc. Once in a mold, additional brazing or metal particulate material may be added to the assembly in order to add substance to the forming body. Additionally, superabrasive particles of different sized may be assembled in order to reduce the amount of interstitial spaces between particles, and provide a rigid and durable polycrystalline body. Other techniques of reducing interstitial space may also be applied to the diamond agglomerate while in a mold, such as shaking, vibrating, etc.

The consolidated coated diamond particles may additionally be infiltrated with a number of specific material aimed at attaining a specific purpose. For example, molten Si may be infiltrated through the diamond agglomerate during the formation of the diamond body in order to create a tool capable of dissipating heat, such as a heat spreader. A number of other specific tools that can be creating using the present technology will be recognized by those of ordinary skill in the art, such as drill bits, saws, and other cutting tools.

The following examples present various methods for making the coated superabrasive particles of the present invention. Such examples are illustrative only, and no limitation on present invention is meant thereby.

EXAMPLES

Example 1

Diamond grits of 40/50 mesh were covered with thin film of an acrylic binder. The binder covered diamond was then mixed with a powdered metallic alloy containing B, Ni, Cr, Si, having an average particle size of about 325 mesh, and sold under the trade name NICHROBRAZ LM® (Wall Colomnoy). The result is a braze powder wrapped diamond. These coated grits were then mixed with fine powder of $Al_2O_3$. The mixture was heated in a vacuum furnace held at $10^{-5}$ torr to a maximum temperature of about 1005° C. for approximately 17 minutes to assure that the metallic alloy coating became molten and liquefied and flowed around the diamond particles wetting them. The mixture was then cooled and retrieved from the furnace. After separating the diamond particles from $Al_2O_3$, a number of coated particles were mixed with a cobalt powder and sintered in a hot press to form rectangular segments. Some of these segments broken by bending with pliers. The fractured surface was then viewed under a microscope. It was observed that the fracture plane propagated through the coated diamond particles rather than deviating around the interface between the diamond particle and the coating, as is typical of sintered diamond particles without the braze coating described above.

Example 2

The same procedure as outlined in Example 1 was followed, but the $Al_2O_3$ separator powder was replaced with diamond particles having an average mesh size of from about 325 to about 400 mesh. During the heating process, the smaller diamond particles wetted by the braze alloy coating, and became chemically bonded to the outside of the coated diamond particle. Thus, coated diamond particles having a chemically bonded metallic alloy shell with smaller diamond particles further bonded to the outside of the shell were produced. These "spiky" coated particles were incorporated into a cobalt matrix and fracture tested as above with similar results achieved.

Example 3

The process of Example 2 was followed, but the smaller diamond particles were replaced with particles of SiC. The process yielded a coated diamond particle having ceramic particles bonded to the outside of the metallic coating similar to the diamond particles of Example 2. Moreover, the fracture testing yielded results similar to that of Examples 1 and 2.

Example 4

Diamond particles were coated with a powdered braze alloy as in Example 1, and then lined up in a groove carved on an $Al_2O_3$ plate. A small amount of braze powder was packed in between the coated particles, and the assembly was heated in a furnace as in Example 1. The resultant "needle" was fracture tested as in the previous examples, and revealed fracture across a diamond grit, rather than fracture around the diamond grit at the interface of the diamond and the metal alloy coating, or between diamond particles.

Example 5

The same procedure was followed as in Example 4, however, diamond coated particles were spread out on the $Al_2O_3$ plate. Braze powder was then packed between the coated particles and the assembly was heated as in the previous examples. The resultant diamond plate of diamond grit bonded by brazing alloy was then fracture tested as in previous examples. Analysis of the fracture plains revealed random fractures that included fractures through various diamond particles, rather than a pattern of fractures following the diamond particle arrangement and falling primarily at the diamond particle/metallic coating interfaces.

Example 6

The procedure of Examples 4 and 5 was again followed, only the interstices between coated diamond particles were filled with a mixture of WC and the braze powder used to coat the diamond particles. Heating in accordance with the prior examples was again conducted, and a tile of the composite materials was obtained. The tile was fracture tested, and the results proved to be consistent with those obtained for the above-recited examples.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method of chemically bonding a superabrasive particle to a braze alloy coating comprising the steps of:

covering the superabrasive particle with an organic binder material;

adhering a powdered form of braze alloy to the superabrasive particle with the organic binder material;

heating the braze alloy to a temperature sufficient to cause the alloy to melt and coat and chemically bond to the superabrasive particle; and solidifying the braze alloy around the superabrasive particle, such that the braze alloy becomes chemically bonded with the superabrasive particle.

2. The method of claim 1, wherein the superabrasive particle is diamond.

3. The method of claim 1, wherein the superabrasive particle is cBN.

4. The method of claim 1, wherein the braze alloy has a melting temperature that is less than a thermal stability limit of the superabrasive particle.

5. The method of 4, wherein the melting temperature is less than about 1100° C.

6. The method of claim 1, wherein the braze alloy contains at least about 1% of a reactive element selected from the group consisting of: Al, B, Cr, Li, Mg, Mo, Mn, Nb, Si, Ta, Ti, V, W, Zr, and mixtures thereof.

7. The method of claim 6, wherein the reactive element is Cr.

8. The method of claim 1, wherein the coating has a thickness of at least about 1 micrometer.

9. The method of claim 1, wherein the coating has a thickness of at least about 10 micrometers.

10. The method of claim 1, wherein a plurality of superabrasive particles are coated simultaneously, and wherein prior to the step of heating, the method further comprises the steps of:

distributing the superabrasive particles in a separator that allows separation of the particles during heating;

heating the braze alloy to a temperature sufficient to cause the alloy to melt and coat and chemically bond to the superabrasive particle; and removing the superabrasive particles from the separator.

11. The method of claim 10, wherein the separator is a powder which is non-reactive with the reactive metal alloy.

12. The method of claim 11, wherein the non-reactive powder is either an oxide powder, or a nitride powder.

13. The method of claim 12, wherein the separator is a member selected from the group consisting of: $Al_2O_3$, $SiO_2$, $ZrO_2$, BN, AlN, and mixtures thereof.

14. The method of claim 10, wherein the separator is a plate with a plurality of apertures therein.

15. The method of claim 1, wherein the step of coating is preceded by the step of:

forming a layer of a material selected from the group consisting of: Cr, Si, Ti, and W on the superabrasive particle.

16. The method of claim 15, wherein the material is Ti.

17. The method of claim 1, wherein at least about 40% of the superabrasive particle surface is wetted by the molten braze alloy.

18. A method of chemically bonding a superabrasive particle to a braze alloy coating comprising the steps of:

coating the superabrasive particle with the braze alloy in a molten liquid state;

solidifying the braze alloy around the superabrasive particle, such that the braze alloy becomes chemically bonded with the superabrasive particle; and applying at least one metallic overcoat layer to the solidified braze alloy coating.

19. The method of claim 18, wherein the metallic overcoat includes at least one metal selected from the group consisting of Co, Cu, Fe, Ni, and mixtures thereof.

20. The method of claim 18, wherein a total coating thickness is achieved around the superabrasive particle that is greater than a diameter of the superabrasive particle.

21. The method of claim 1, further comprising the step of bonding a plurality of abrasive particles, each having a size that is smaller than the superabrasive particle, to an outer portion of the braze alloy coating.

22. The method of claim 21, wherein the plurality of particles are superabrasive particles.

23. The method of claim 21, wherein the plurality of particles are carbides.

24. The method of claim 23, wherein the carbide is a member selected from the group consisting of: SiC, WC, and Ti coated cBN.

25. The method of claim 1, further comprising the step of: coupling a plurality of braze alloy coated superabrasive particles to form a tool.

26. A coated superabrasive particle comprising:

a superabrasive particle;

a solidified coating of a molten braze alloy chemically bonded to the superabrasive particle; and at least one metallic overcoat layer bonded to the solidified braze alloy coating said overcoat layer including at least one metal selected from the group consisting of Co, Cu, Fe, Ni, and mixtures thereof.

27. The coated superabrasive particle of claim 26, wherein the superabrasive is diamond.

28. The coated superabrasive particle of claim 26, wherein the superabrasive is cBN.

29. The coated superabrasive particle of claim 26, wherein the braze alloy has a melting temperature below a thermal stability limit of the superabrasive particle.

30. The coated superabrasive particle of claim 29, wherein the melting temperature is less than about 1100° C.

31. The coated superabrasive particle of claim 26, wherein the braze alloy contains at least about 1% of a reactive element selected from the group consisting of: Al, B, Cr, Li, Mg, Mo, Mn, Nb, Si, Ta, Ti, V, W, Zr, and mixtures thereof.

32. The coated superabrasive particle of claim 26, wherein the coating has a thickness of at least about 1 micrometer.

33. The coated superabrasive particle of claim 26, wherein the coating has a thickness of at least about 10 micrometers.

34. The coated superabrasive particle of claim 26, wherein at least about 40% of the superabrasive particle surface is wetted by the molten brazing alloy.

35. The coated superabrasive particle of claim 26, wherein a total coating thickness is achieved around the superabrasive particle that is greater than a diameter of the superabrasive particle.

36. A coated superabrasive particle comprising:

a superabrasive particle;

a solidified coating of a molten braze alloy chemically bonded to the superabrasive particle; and a plurality of abrasive particles, each having a size that is smaller than the superabrasive particle, bonded to an outer portion of the braze alloy coating.

37. The coated superabrasive particle of claim 36, wherein the plurality of particles are superabrasive particles.

38. The coated superabrasive particle of claim 36, wherein the plurality of particles are carbides.

39. The coated superabrasive particle of claim 38, wherein the carbide is a member selected from the group consisting of: SiC, WC, and Ti coated cBN.

40. A method of making a superabrasive tool, comprising the steps of:

a) providing a plurality of a superabrasive particles, each having a solidified coating of a molten braze chemically bonded thereto;

b) providing a metal matrix material into which the coated superabrasive particles are to be incorporated;

c) positioning the coated superabrasive particles in the metal matrix in accordance with a predetermined patter; and d) heating the coated superabrasive particles and metal matrix to a temperature sufficient to affix the coated superabrasive particles to the metal matrix.

41. The method of claim 40, wherein the superabrasive tool is a one dimensional tool.

42. The method of claim 40, wherein the superabrasive tool is a two dimensional tool.

43. The method of claim 40, wherein the superabrasive tool is a three dimensional tool.

* * * * *